US006068123A

United States Patent [19]

Chen

[11] Patent Number: 6,068,123

[45] Date of Patent: May 30, 2000

[54] DRAWER ASSEMBLY FOR A TOOL BOX

[76] Inventor: Shwu Ruu Chen, 1F, 1, Alley 16, Lane 40, Jinn Te Rd., Taichung, Taiwan

[21] Appl. No.: 09/312,898

[22] Filed: May 17, 1999

[51] Int. Cl.[7] ..... B65D 85/28

[52] U.S. Cl. ..... 206/373; 312/902

[58] Field of Search ..... 206/372, 373, 206/376, 379; 312/249.4, 350, 902

[56] References Cited

U.S. PATENT DOCUMENTS

| | | | |
|---|---|---|---|
| 4,303,158 | 12/1981 | Perkins | 206/373 |
| 5,114,007 | 5/1992 | Chen | 206/373 |
| 5,271,501 | 12/1993 | Chen | 206/373 |
| 5,409,560 | 4/1995 | Hammer et al. | 206/564 |

*Primary Examiner*—Paul T. Sewell
*Assistant Examiner*—Nhan T. Lam

[57] ABSTRACT

A drawer assembly includes a drawer retractably received in a receiving portion of a tool box and a driving device is located beside one of two opposite side walls of the drawer. A rack is attached to the inside of one of the two side walls and the driving device has a motor to rotate a gear which is engaged with the rack. A resilient link is disengagably engaged with the rack and connected to a button. When the button is pushed to disengage the resilient link from the rack, the motor rotates the gear to let the drawer slide out from the receiving portion. When the drawer is pushed into the receiving portion, the resilient link is engaged with the rack to position the drawer.

1 Claim, 6 Drawing Sheets

DRAWER ASSEMBLY FOR A TOOL BOX

FIELD OF THE INVENTION

The present invention relates to a drawer assembly, and more particularly, to a drawer retractably received to a tool box and cooperated with a driving means. The driving means comprises a motor and a gear which is engaged with a rack attached to the drawer so that the drawer can be opened or closed by pushing a button of the driving means.

BACKGROUND OF THE INVENTION

Some of the tool boxes have a drawer retractably received in the body of the tool box. The drawer is used to store small parts such as bits, nuts or bolts so that the user may pick the one he/she needs from the parts in the drawer. The drawer generally is opened and closed by the hand of the user, the outside of the drawer is therefore attached with the lubricant or oil. This makes the tool box have an ugly outer appearance. Besides, the drawer generally has two side grooves defined in two sides thereof so as to movably receive the corresponding two rails on the inside of the tool box so that the drawer can be moved along the two rails. Nevertheless, the width of each rail is limited and the parts in the drawer could be so heavy, the drawer tends to be inclinedly disengaged from the rails when pulling the drawer in the tool box.

The present invention intends to provide a drawer assembly which is opened and closed by a driving means which includes a motor and a gear engaged with a rack attached to a side of the drawer. The drawer will be smoothly opened or closed by simply pushing a button of the driving means.

The present invention has arisen to obviate the disadvantages of the conventional drawer assembly in a tool box.

SUMMARY OF THE INVENTION

In accordance with one aspect of the present invention, there is provided a drawer assembly and a tool box wherein the tool box comprises a main body having two side members respectively and pivotally connected to two sides thereof, and a receiving portion is connected to one of two ends of the main body. The receiving portion has an opening and an aperture respectively defined in an end thereof. Two rails are attached to two opposite insides of the opening.

A drawer has two grooves defined in two opposite side walls thereof so as to movably receive the two rails. A rack is attached to the inside of one of the two opposite side walls of the drawer. A driving means is received in the receiving portion and includes a motor, a gear driven by the motor and a resilient link which is disengagably engaged with the rack. A button is connected to the resilient link and extends through the aperture. The resilient link is disengaged from the rack when the button is pushed to let the drawer slide out from the receiving portion.

The main object of the present invention is to provide drawer assembly which is used in a tool box and is slid out by simply pushing a button of a driving means.

Further objects, advantages, and features of the present invention will become apparent from the following detailed description with appropriate reference to the accompanying drawings.

DETAILED DESCRIPTION OF THE PREFERRED EMBODIMENT

Figure 1:
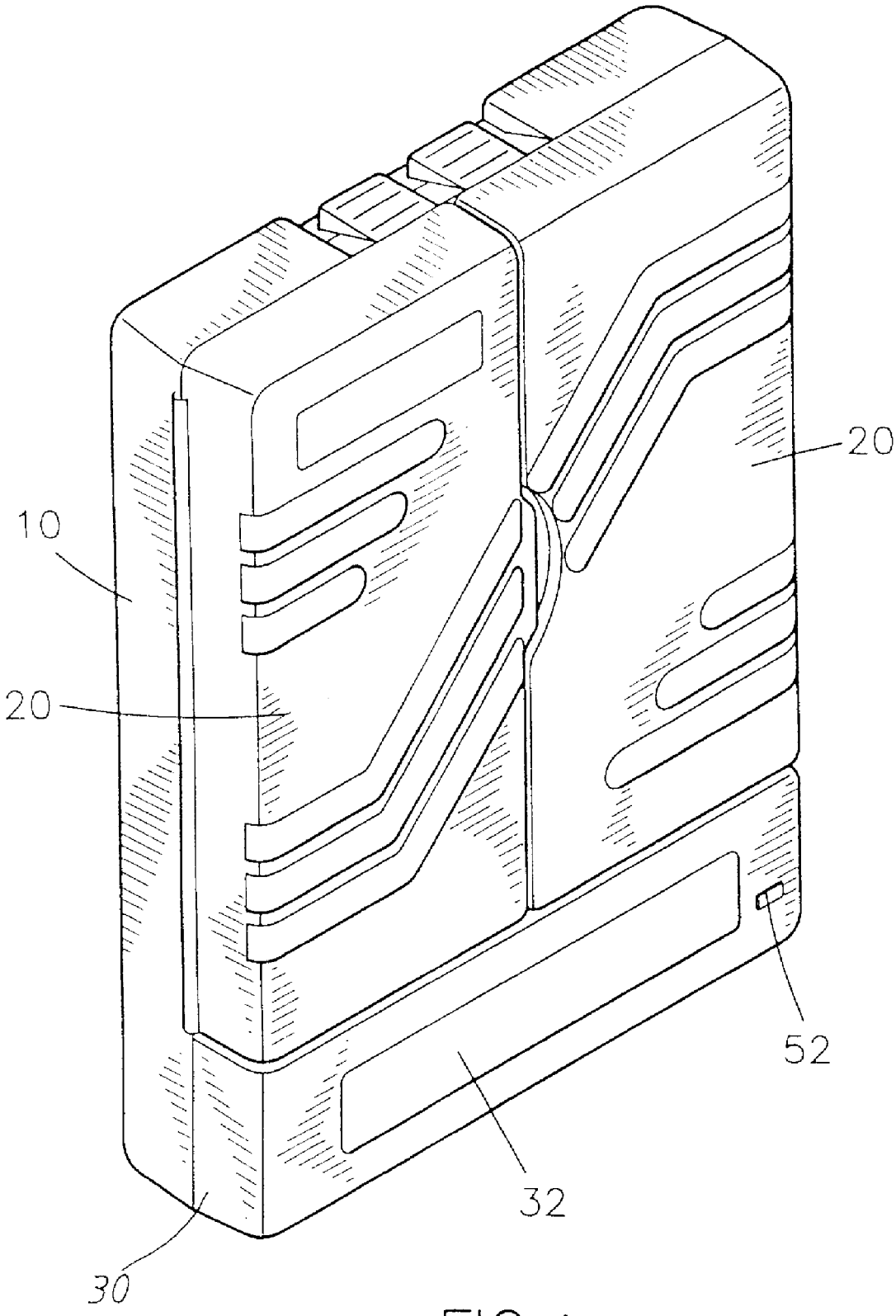
FIG. 1 is a perspective view of the tool box with the drawer received in the receiving portion of the tool box in accordance with the present invention.
Figure 2:
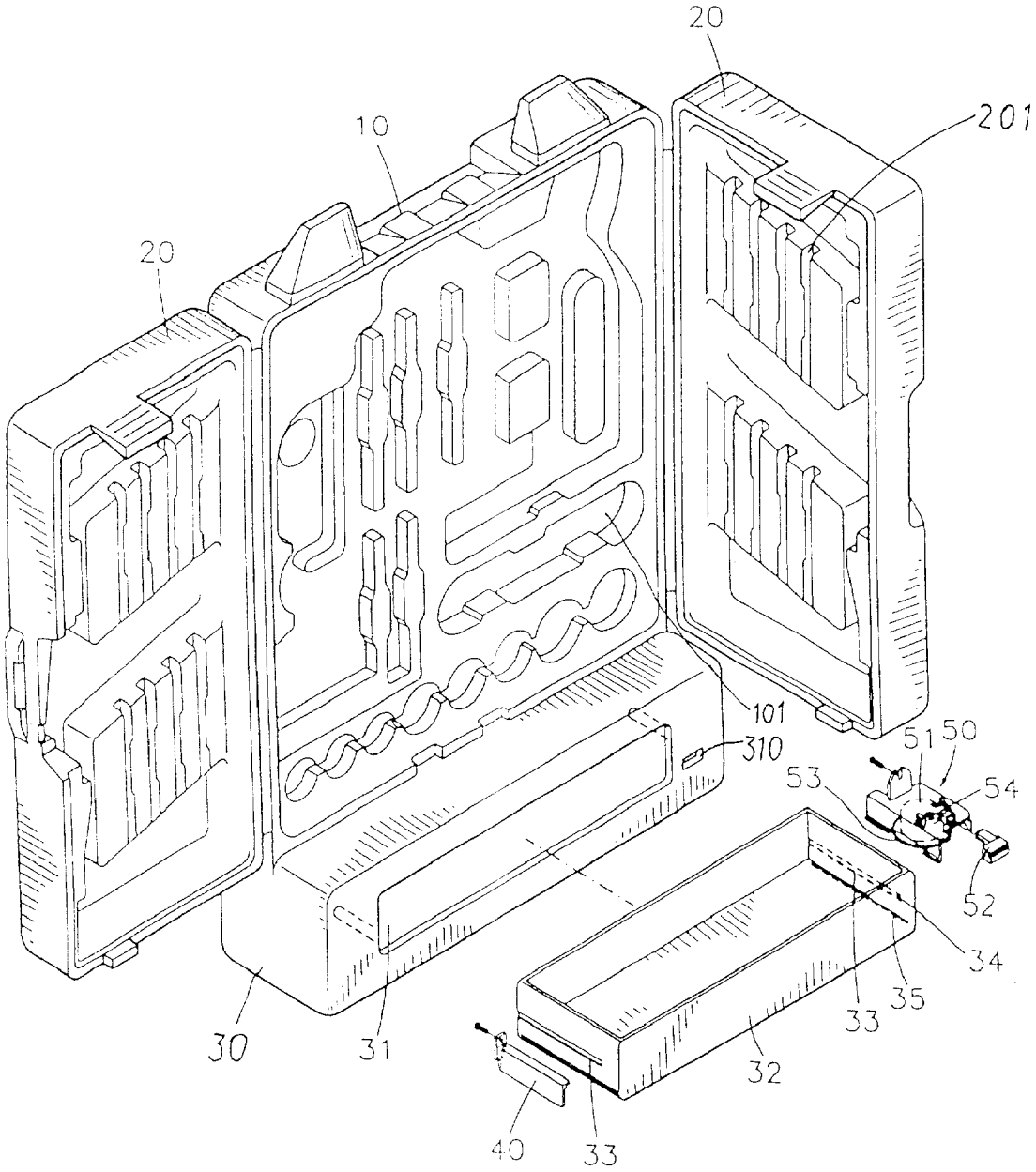
FIG. 2 is an exploded view of the drawer assembly and the tool box in accordance with the present invention.
Figure 3:
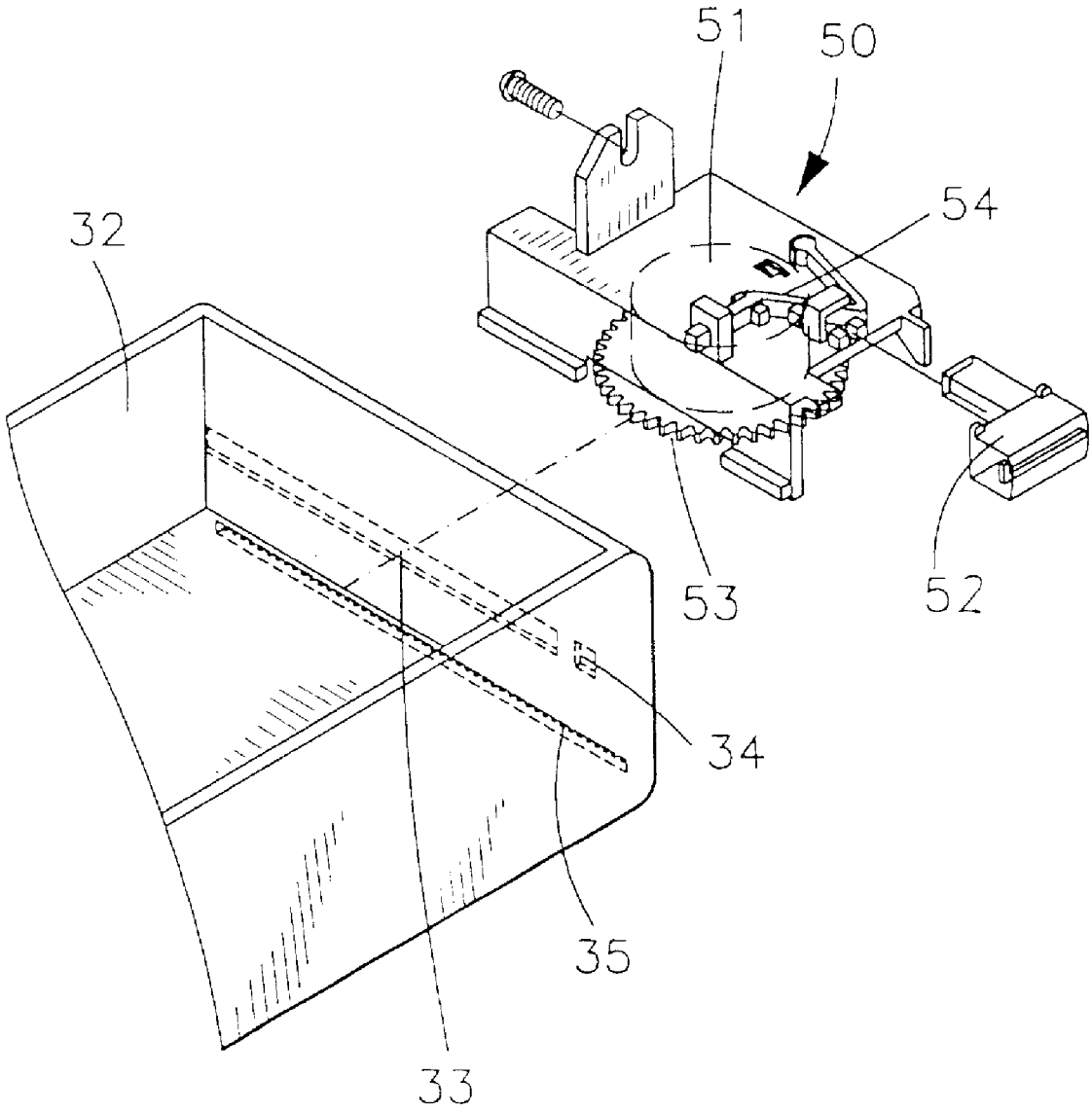
FIG. 3 is an exploded view of the drawer assembly in accordance with the present invention.
Figure 4:
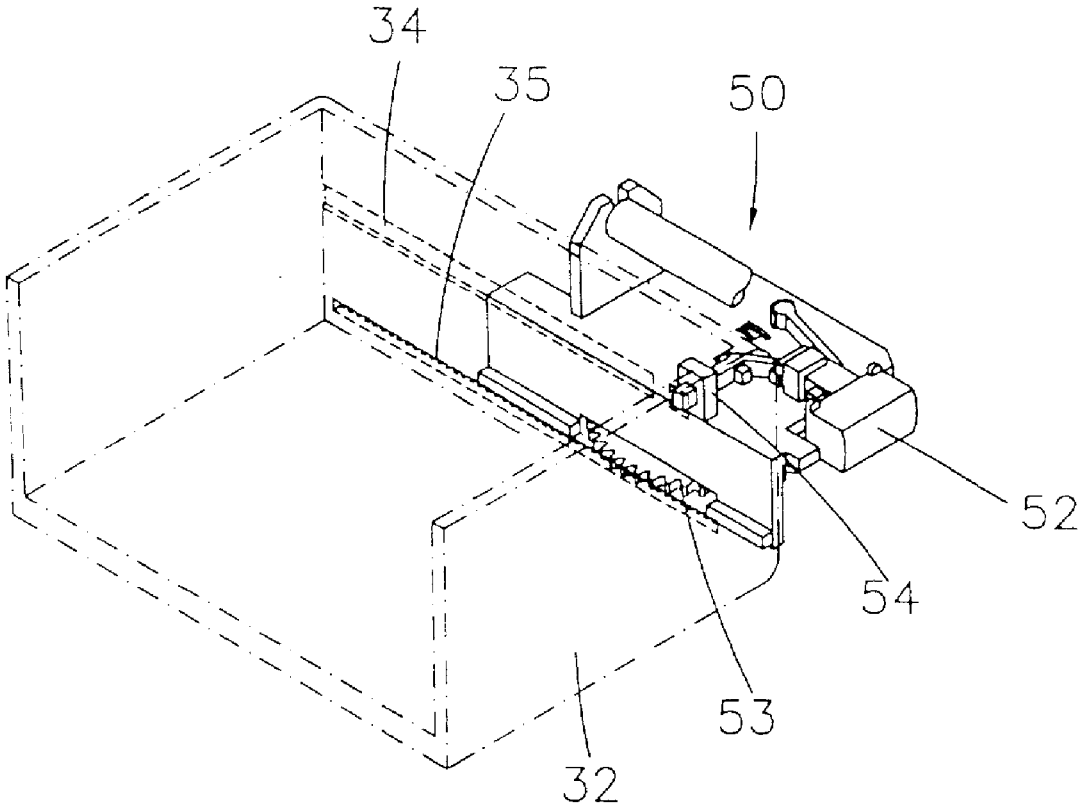
FIG. 4 is a perspective view of the drawer and the driving means in accordance with the present invention.
Figure 5:
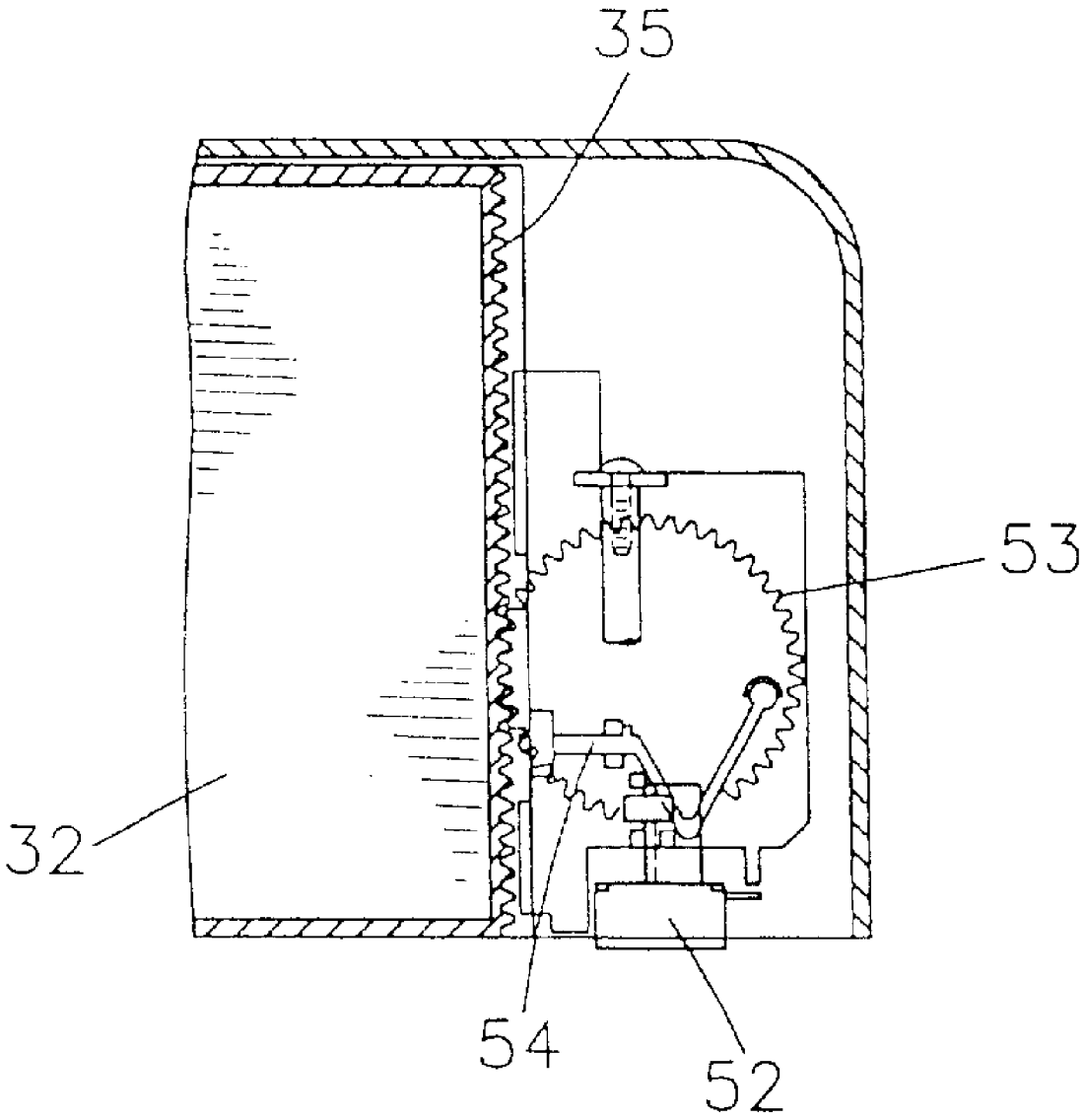
FIG. 5 is a top view, partly in section, of the drawer received in the receiving portion and the resilient link of the driving means is engaged with the rack attached to the drawer in accordance with the present invention.

Referring to FIGS. 1 to 5, the tool box comprises a main body 10 having two side members 20 respectively and pivotally connected to two sides thereof. Each of the main body 10 and the two side members 20 has a plurality of recesses 101, 201 defined therein so as to receive tools (not shown) therein. A receiving portion 30 is connected to one of two ends of the main body 10. An opening 31 and an aperture 310 are respectively defined in the front end thereof so that a drawer 32 is retractably received in the receiving portion 30 via the opening 31. Two rails 40 are attached to two opposite insides of the opening 31.

The drawer 32 has a bottom with four side walls extending therefrom, two grooves 33 defined in two opposite side walls so as to movably receive the two rails 40 such that the drawer can be slid out from the opening 31 along the two rails 40. A rack 35 is attached to the inside of one of the two opposite side walls. A driving means 50 is received in the receiving portion 30 and includes a motor 51, a gear 53 driven by the motor 51 and a resilient link 54 which is disengagably engaged with the rack 35 through a hole 34 defined through the side wall having the rack 35. A button 52 is connected to the resilient link 54 and extends through the aperture 310.

The motor 51 includes a torsion spring which tends to drive the gear 53 to slide the drawer 32 out from the receiving portion 30. The torsion spring is stopped to expand when the resilient link 54 is engaged with the rack 35.

Figure 6:
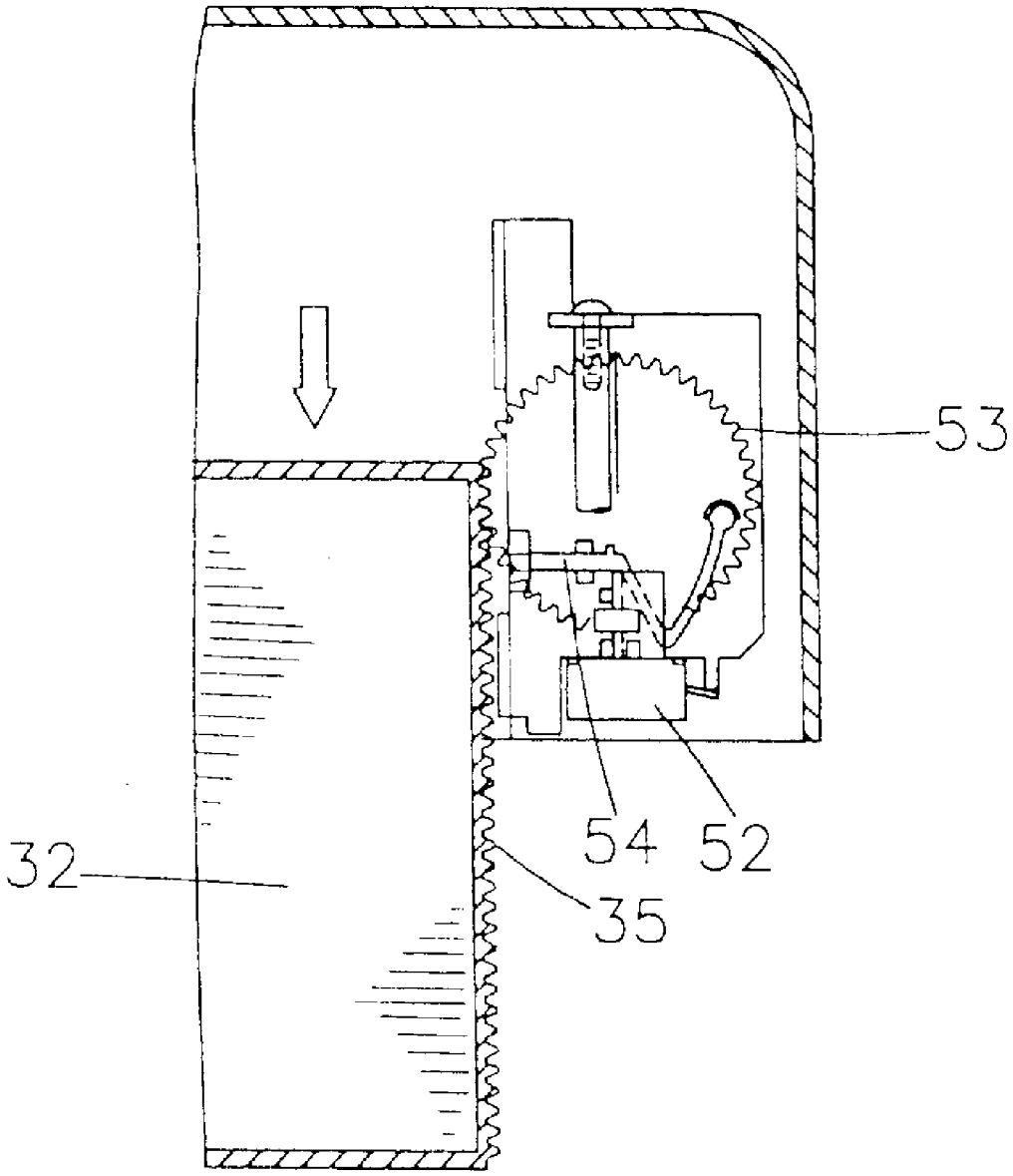
FIG. 6 is a top view, partly in section, of the drawer slid out from the receiving portion while the resilient link of the driving means is disengaged from the rack by pushing the button of the driving means.

Referring to FIG. 6, when the button 52 is pushed, the resilient link 54 is deformed and disengaged from the rack 35 so that the torsion spring is released and the gear is rotates to push the rack 35 together with the drawer 32 out from the receiving portion 30. When pushing the drawer 32 into the receiving portion 30 again, the resilient link 54 is engaged with the rack 35 again.

The invention is not limited to the above embodiment but various modification thereof may be made. It will be understood by those skilled in the art that various changes in form and detail may made without departing from the scope and spirit of the present invention.

What is claimed is:

1. A combination of a drawer assembly and a tool box, said tool box comprising a main body having two side members respectively and pivotally connected to two sides thereof, a receiving portion connected to one of two ends of said main body, an opening and an aperture respectively defined in an end thereof, two rails attached to two opposite insides of said opening;

a drawer having a bottom with four side walls extending therefrom, two grooves defined in two opposite side walls so as to movably receive said two rails, a rack attached to the inside of one of said two opposite side walls, and a driving means received in said receiving portion and including a motor, a gear driven by said motor and a resilient link which is disengagably engaged with said rack, a button connected to said resilient link and extending through said aperture, said resilient link disengaged from said rack when said button is pushed.

* * * * *